US011898360B2

(12) United States Patent
Petty

(10) Patent No.: US 11,898,360 B2
(45) Date of Patent: Feb. 13, 2024

(54) FLOORING INSTALLATION ASSEMBLY

(71) Applicant: Jim Petty, Canon City, CO (US)

(72) Inventor: Jim Petty, Canon City, CO (US)

( * ) Notice: Subject to any disclaimer, the term of this patent is extended or adjusted under 35 U.S.C. 154(b) by 664 days.

(21) Appl. No.: 17/122,575

(22) Filed: Dec. 15, 2020

(65) Prior Publication Data

US 2022/0186508 A1 Jun. 16, 2022

(51) Int. Cl.
*H02G 1/02* (2006.01)
*E04G 21/18* (2006.01)

(52) U.S. Cl.
CPC ..... *E04G 21/1841* (2013.01)

(58) Field of Classification Search
CPC .... B25B 1/00; B25B 1/02; B25B 1/08; B25B 1/14; B25B 5/00; B25B 11/00; B23Q 3/00
See application file for complete search history.

(56) References Cited

U.S. PATENT DOCUMENTS 4,821,784 A 4/1989 Cone
5,248,127 A 9/1993 Young
5,527,014 A 6/1996 Bracewell
5,781,977 A * 7/1998 Servones ..... B25B 27/062 29/259
5,964,450 A 10/1999 Pasto
6,233,899 B1 5/2001 Mellert
7,017,253 B1 * 3/2006 Riggle ..... B25B 1/103 29/256
11,214,968 B2 * 1/2022 Hayes ..... B66F 3/08
2009/0194749 A1 8/2009 Mirocha
2011/0271498 A1 11/2011 Price
2022/0186508 A1 * 6/2022 Petty ..... E04G 21/1841

FOREIGN PATENT DOCUMENTS

CA 2099540 7/1996

* cited by examiner

*Primary Examiner* — Lee D Wilson

(57) ABSTRACT

A flooring installation assembly for pressing a warped floorboard into position for installation includes a mounting plate that is mounted to a floor joist during installation of floorboards onto the floor joist. A pair of rods slidably extends through the mounting plate. Each of the rods extends through a pressure plate such that the pressure plate is spaced from the mounting plate. A push plate is coupled to each of the rods. A nut is coupled to the mounting plate, and a bolt is threaded into the nut to abut the pressure plate. The bolt urges the pressure plate away from the second section of the mounting plate when the bolt is rotated in a first direction such that the push plate compresses the floorboard into position for installation.

11 Claims, 5 Drawing Sheets

FLOORING INSTALLATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to flooring installation devices and more particularly pertains to a new flooring installation device for pressing a warped floorboard into position for installation. The flooring installation device includes a screw that is rotatable to compress against a warped floorboard. Additionally, an electric drill or a hand wrench can be attached to the screw for rotating the screw to compress the warped floorboard into position

(2) Description of Related Art Including Information Disclosed Under 37 CFR 1.97 and 1.98

The prior art relates to flooring installation devices including a variety of levers that are attachable to a floor joist thereby facilitating the lever to compress a floorboard into position when the floorboard is warped. In at least one instance the lever includes a mechanism for pressing against the floorboard. The prior art discloses a pressing device that is mountable to a floor joist and which includes a screw for pressing against a floorboard.

BRIEF SUMMARY OF THE INVENTION

An embodiment of the disclosure meets the needs presented above by generally comprising a mounting plate that is mounted to a floor joist during installation of floorboards onto the floor joist. A pair of rods slidably extends through the mounting plate. Each of the rods extends through a pressure plate such that the pressure plate is spaced from the mounting plate. A push plate is coupled to each of the rods. A nut is coupled to the mounting plate, and a bolt is threaded into the nut to abut the pressure plate. The bolt urges the pressure plate away from the second section of the mounting plate when the bolt is rotated in a first direction such that the push plate compresses the floorboard into position for installation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
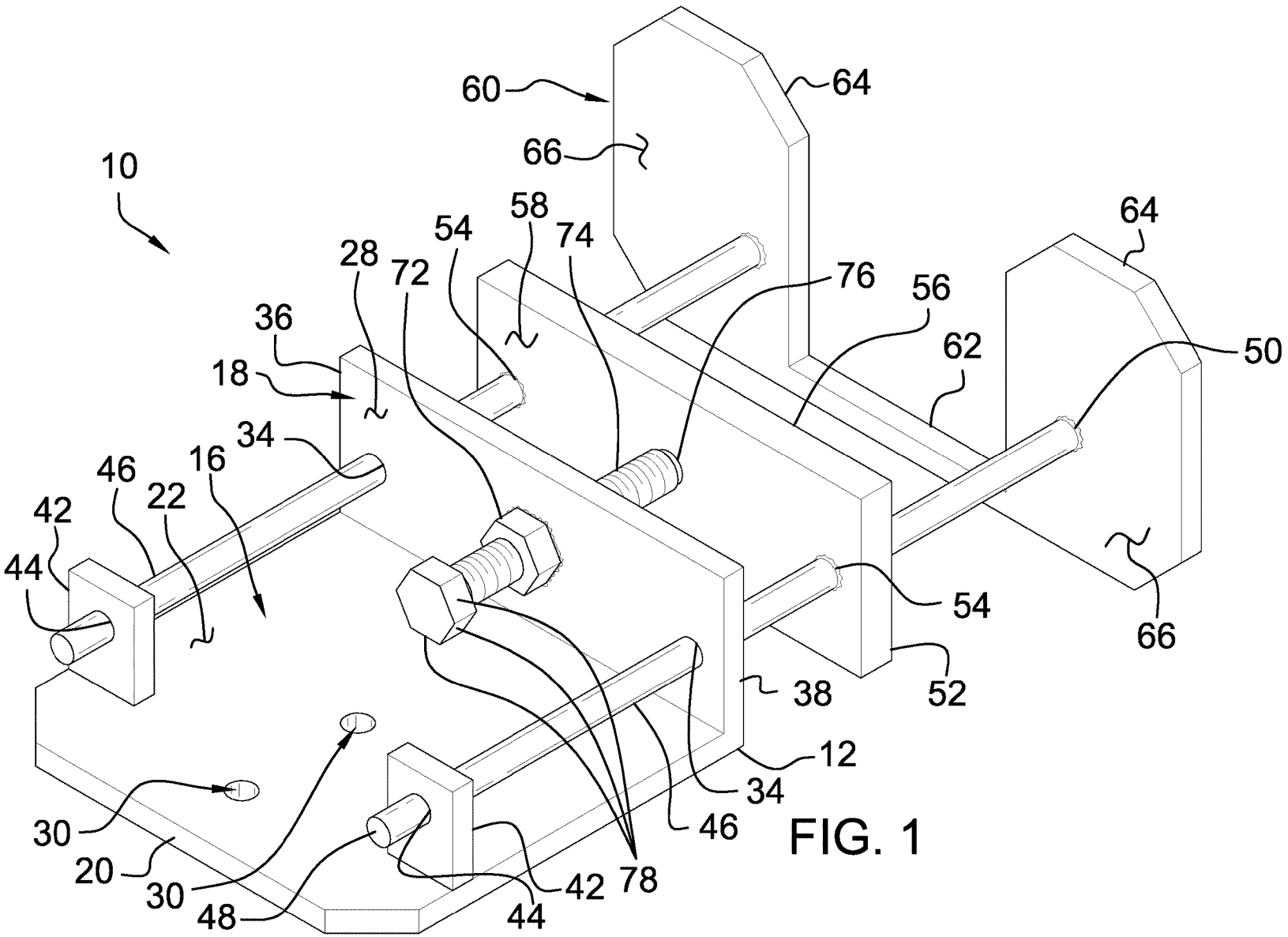
FIG. 1 is a top perspective view of a flooring installation assembly according to an embodiment of the disclosure.
Figure 2:
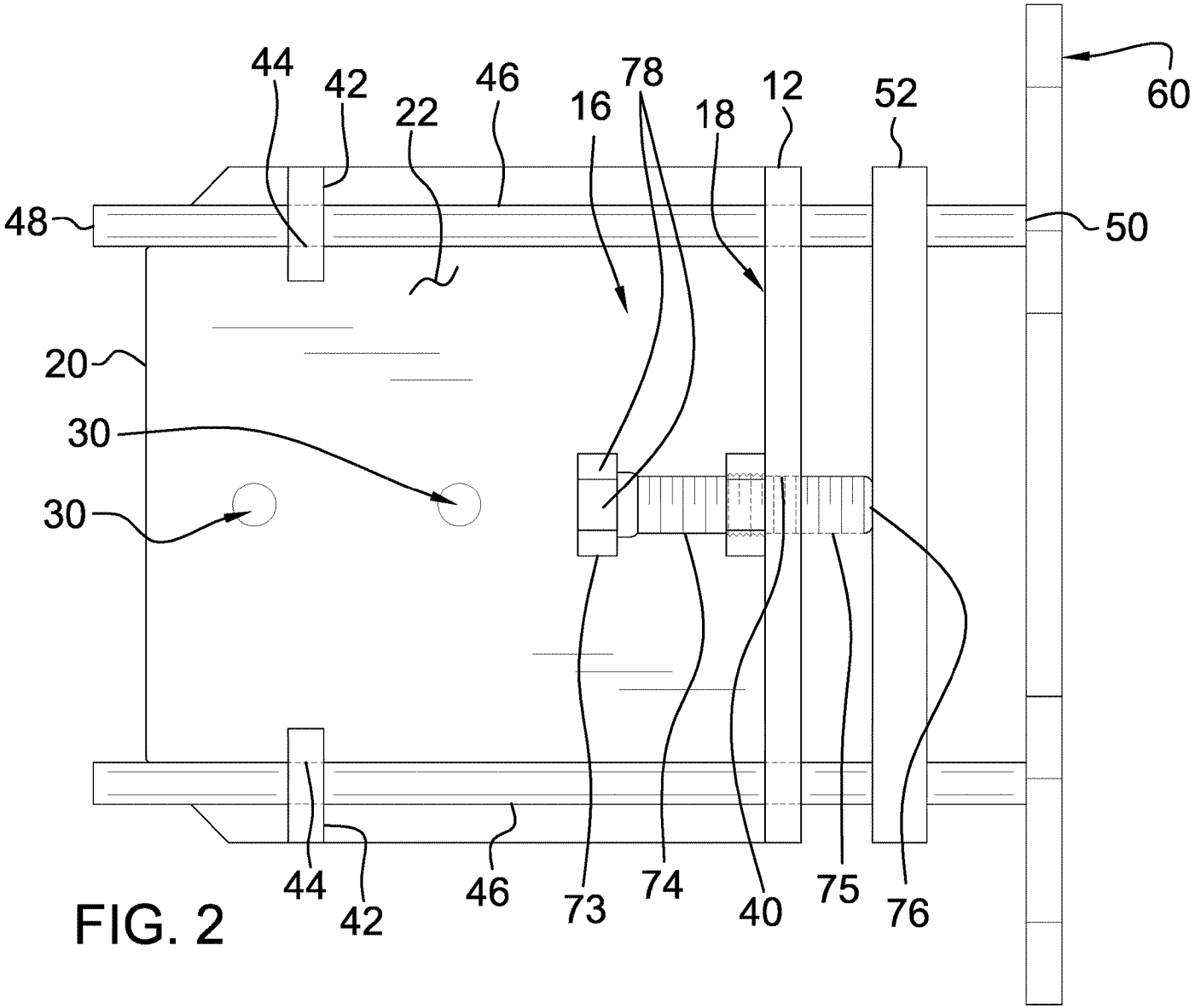
FIG. 2 is a top view of an embodiment of the disclosure.
Figure 4:
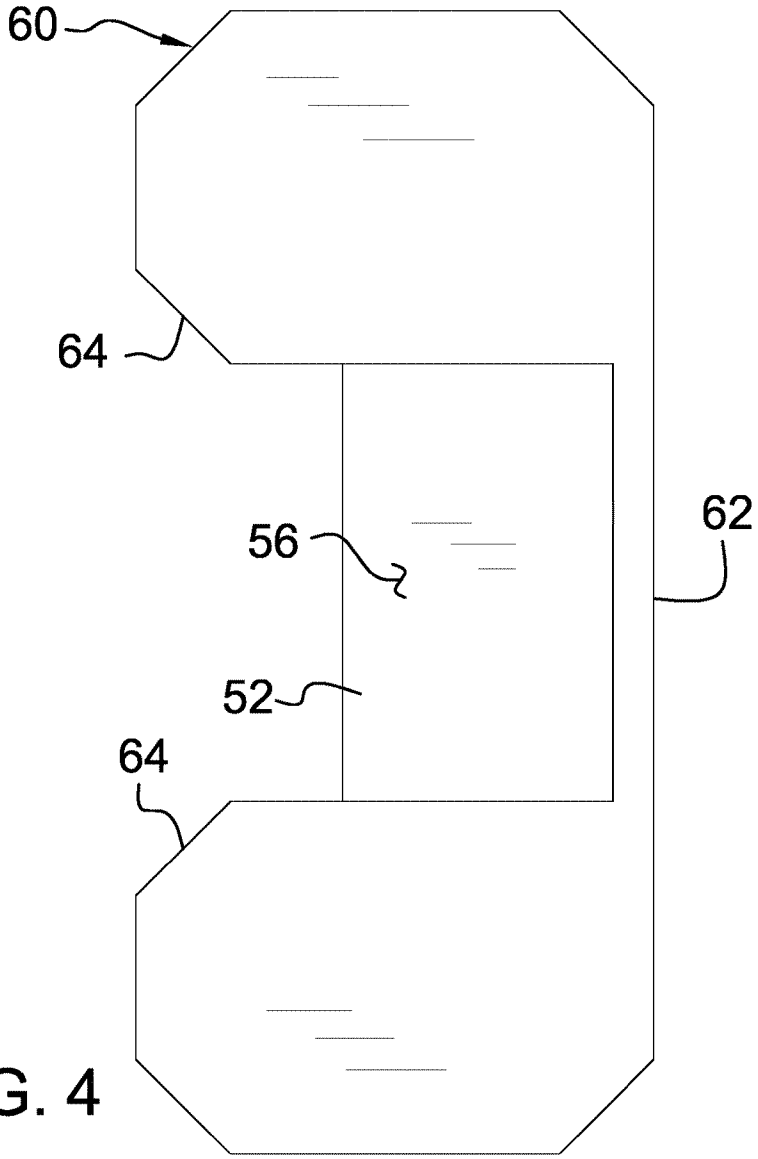
FIG. 4 is a front view of an embodiment of the disclosure.
Figure 3:
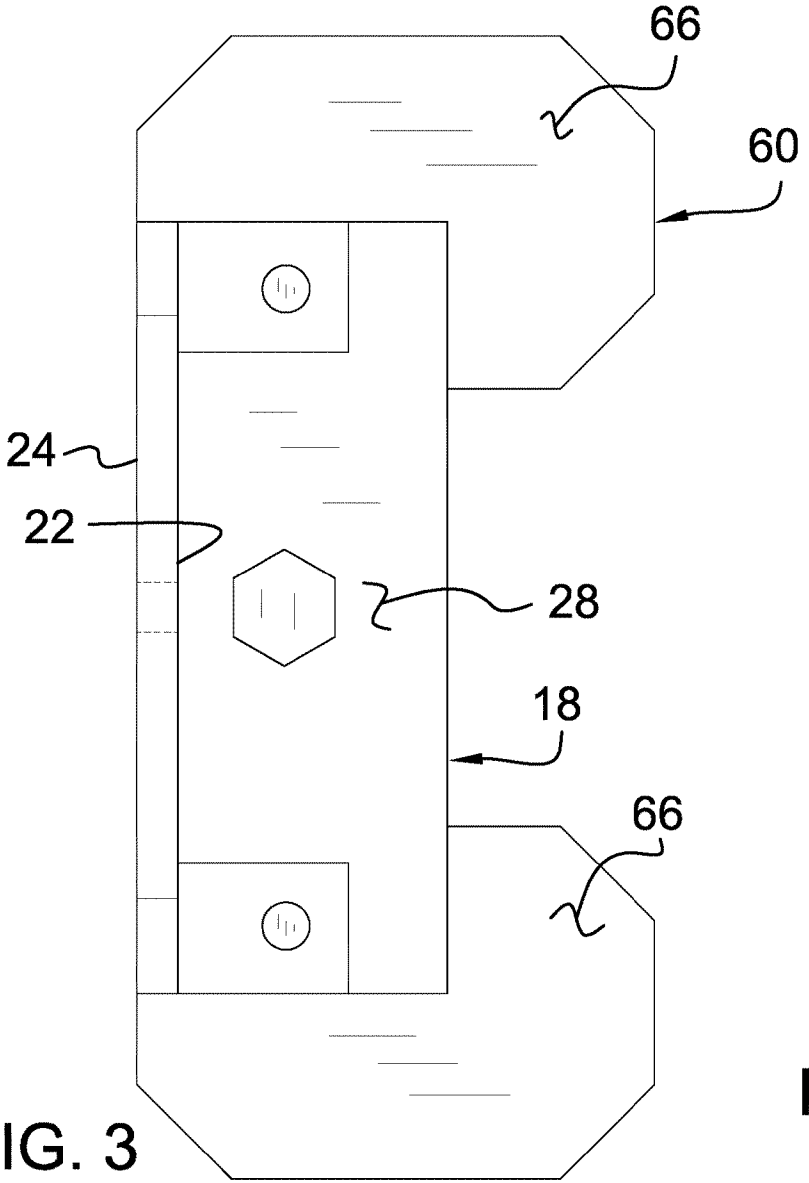
FIG. 3 is a back view of an embodiment of the disclosure.
Figure 5:
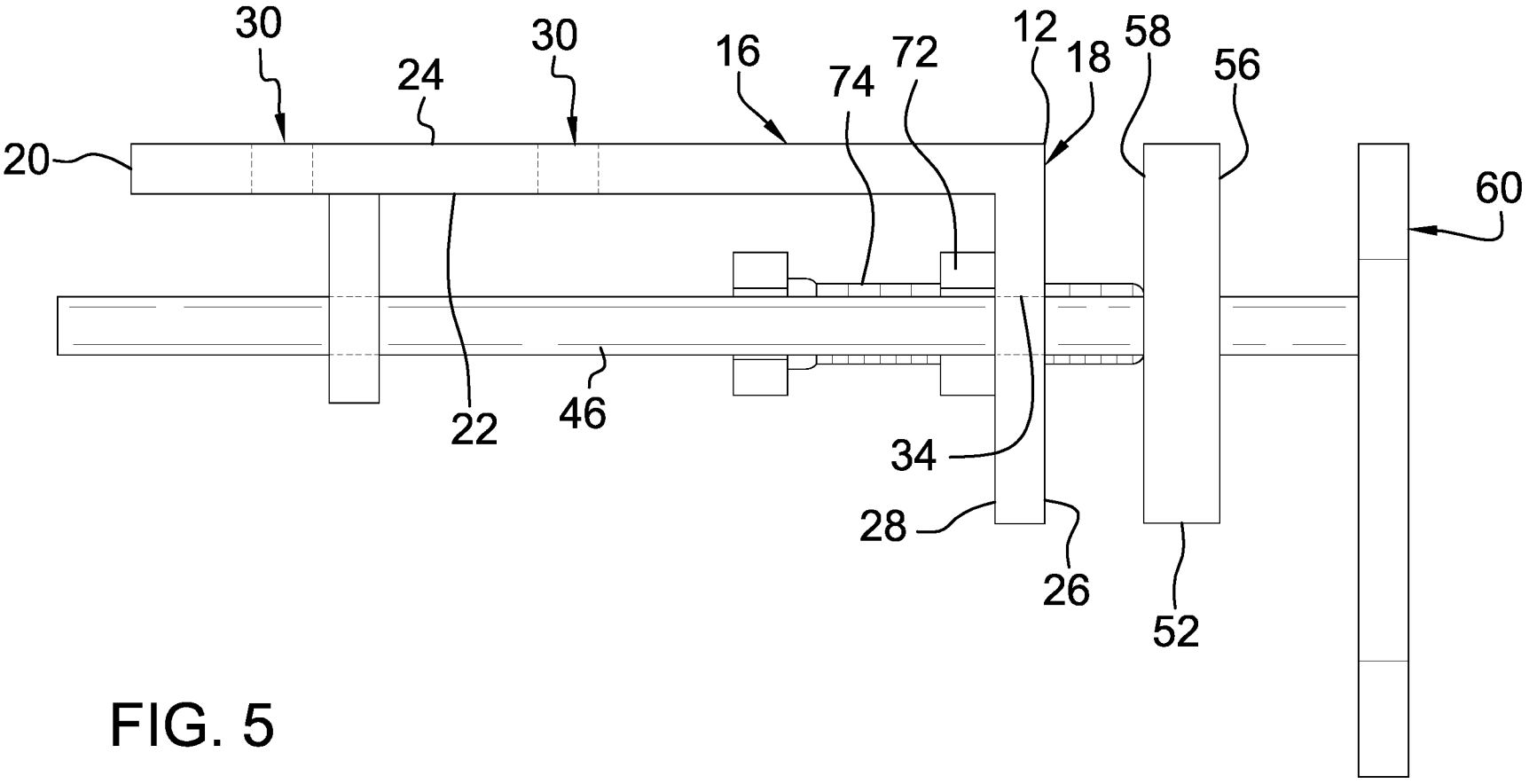
FIG. 5 is a left side view of an embodiment of the disclosure.
Figure 6:
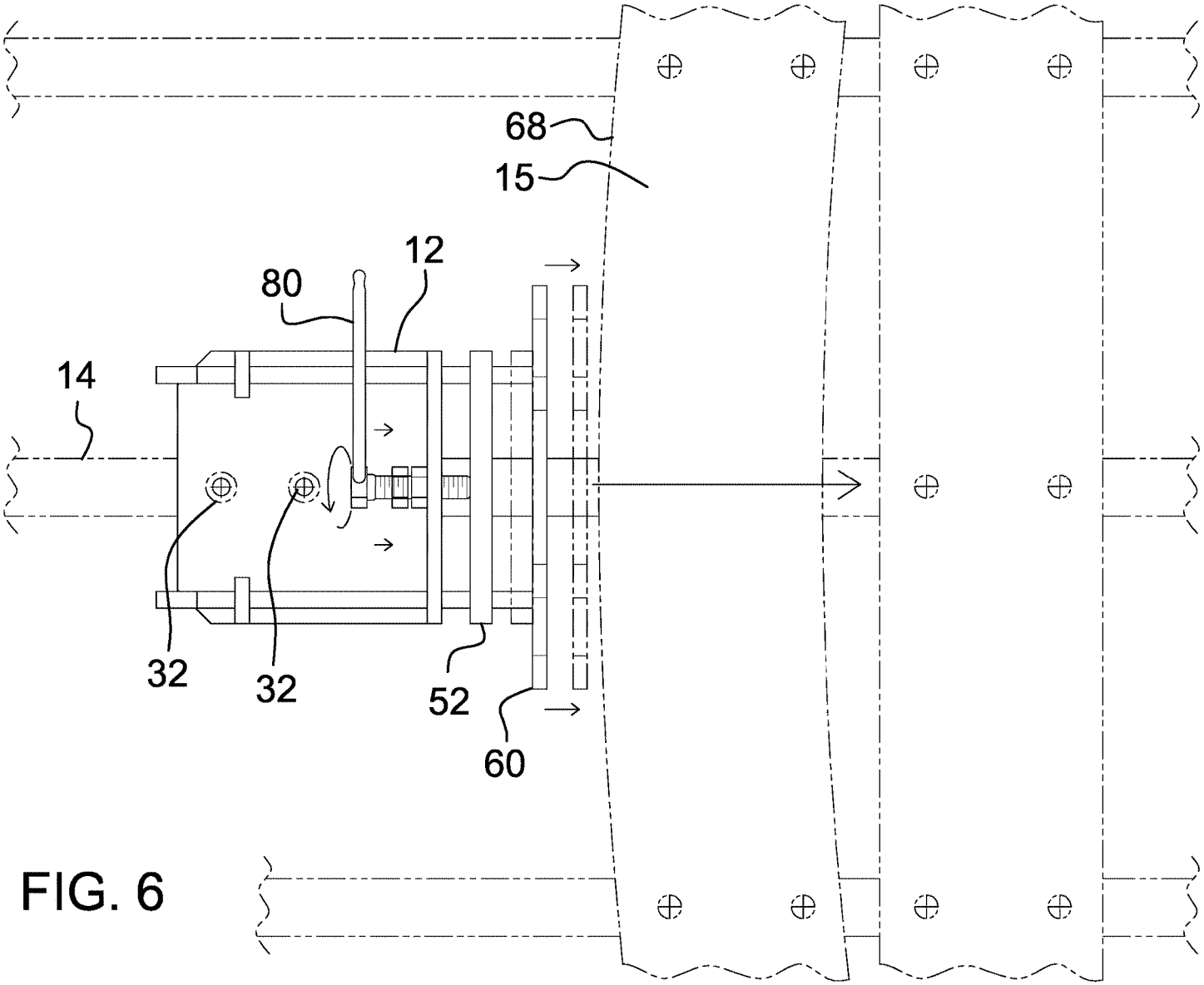
FIG. 6 is a perspective in-use view of an embodiment of the disclosure.

With reference now to the drawings, and in particular to FIGS. 1 through 6 thereof, a new installation device embodying the principles and concepts of an embodiment of the disclosure and generally designated by the reference numeral 10 will be described.

As best illustrated in FIGS. 1 through 6, the flooring installation assembly 10 generally comprises a mounting plate 12 that can be mounted to a floor joist 14 during installation of floorboards 15 onto the floor joist 14. The mounting plate 12 comprises a first section 16 that is oriented perpendicular to a second section 18, and the first section 16 has a distal edge 20 with respect to the second section 18. The first section 16 has a top surface 22 and a bottom surface 24, and the bottom surface 24 can lie on top of the floor joist 14. The second section 18 has a front surface 26 and a back surface 28, and the back surface 28 lies on a perpendicular plane with respect to the top surface 22.

The first section 16 has a pair of fastener holes 30 each extending through the top surface 22 and the bottom surface 24. Each of the fastener holes 30 can accommodate a fastener 32 to engage the floor joist 14 for fastening the mounting plate 12 to the joist. The fastener 32 may be a screw, a nail or other type of removable, penetrating fastener. The fastener holes 30 are spaced apart from each other and are distributed between the distal edge 20 and the second section 18. The second section 18 has a pair of rod holes 34 each extending through the front surface 26 and the back surface 28. Each of the rod holes 34 is positioned adjacent to a respective first lateral edge 36 and a second lateral edge 38 of the second section 18. Additionally, the second section 18 has a bolt opening 40 extending through the front surface 26 and the back surface 28, and the bolt opening 40 is centrally positioned between the pair of rod holes 34.

A pair of tabs 42 is provided and each of the tabs 42 extends upwardly from the top surface 22 of the first section 16. Each of the tabs 42 is oriented to lie on a plane which is oriented perpendicular to the back surface 28 of the second section 18. Additionally, each of the tabs 42 is positioned closer to the distal edge 20 of the first section 16 than the back surface 28 of the second section 18. Each of the tabs 42 has a rod opening 44 extending therethrough and the rod opening 44 in each of the tabs 42 is aligned with a respective one of the rod holes 34 in the second section 18.

A pair of rods 46 each slidably extends through the second section 18 of the mounting plate 12, and each of the rods 46 has a first end 48 and a second end 50. Each of the rods 46 extends through a respective one of the rod holes 34 in the second section 18 of the mounting plate 12 and the rod opening 44 in a respective one of the tabs 42 having the first end 48 being spaced from each of the tabs 42. A pressure plate 52 is provided and each of the rods 46 extends therethrough such that the pressure plate 52 is spaced from the second section 18 of the mounting plate 12. The pressure plate 52 has a pair of welds 54 between the pressure plate 52 and a respective one of the rods 46 for attaching the pressure plate 52 to the rods 46. The pressure plate 52 has a forward surface 56 and a rearward surface 58, and the rearward surface 58 is directed toward the front surface 26 of the second section 18. Additionally, each of the rods 46 extends through the rearward surface 58 and the forward surface 56.

A push plate 60 is coupled to each of the rods 46, and the push plate 60 has a central member 62 extending between a pair of lobes 64. Each of the lobes 64 has a primary surface 66 that is directed toward the forward surface 56 of the pressure plate 52. The second end 50 of each of the rods 46 is welded to the primary surface 66 of a respective one of the lobes 64. Each of the lobes 64 extends upwardly from the central member 62 to rest on the floor joist 14 having each of the lobes 64 abutting a lateral edge 68 of a floorboard 15 that is being installed on the floor joist 14.

A nut 72 is coupled to the back surface 28 of the second section 18 and the nut 72 is aligned with the bolt opening 40 in the second section 18. A bolt 74 is threaded into the bolt 74 and the bolt 74 abuts the pressure plate 52. The bolt 74 urges the pressure plate 52 away from the second section 18 of the mounting plate 12 when the bolt 74 is rotated in a first direction. In this way the bolt 74 urges the pressure plate 52 away from the mounting plate 12 and the pressure plate 52 compresses the floorboard 15 into position for installation. In this way a floorboard 15 that is warped can be straightened for proper installation. The bolt 74 facilitates the pressure plate 52 to be moved toward the second section 18 of the mounting plate 12 when the bolt 74 is rotated in a second direction.

The bolt 74 has a head 73 and a stem 75, and the stem 75 is threaded to facilitate the stem 75 to threadably engage the nut 72. The stem 75 has a distal end 76 with respect to the head 73 and the distal end 76 abuts the rearward surface 58 of the pressure plate 52. The head 73 has a plurality of intersecting lateral edges 78 thereby facilitating the head 73 to be engaged by a wrench 80 to rotate the bolt 74. The wrench 80 might be a hand held wrench, such as a socket wrench or the like, or the wrench 80 may be a power tool, such as an electric drill with an appropriate bit installed to engage the head 73 of the bolt 74.

In use, the mounting plate 12 is positioned on the floor joist 14 such that the rods 46 are oriented perpendicular to the floorboard 15 and the fasteners 32 are extended through the fastener holes 30 to engage the floor joist 14 and attach the mounting plate 12 to the floor joist 14. The wrench 80 is positioned on the head 73 of the bolt 74 and the bolt 74 is rotated in the first direction. In this way the pressure plate 52 is pressed against the lateral edge of the floorboard 15 to compress the floorboard 15 against an adjacent floorboard 15. Thus, a warped floorboard 15 can be urged into position for proper installation. The bolt 74 is rotated in the second direction and the mounting plate 12 is removed from the floor joist 14 when the floorboard 15 is fastened into place.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A flooring installation assembly for pressing a warped floorboard into position for proper installation, said assembly comprising:

a mounting plate being configured to be mounted to a floor joist during installation of floorboards onto the floor joist, said mounting plate comprising a first section being oriented perpendicular to a second section wherein said first section is configured to rest on the floor joist;

a pair of rods, each of said rods slidably extending through said second section of said mounting plate;

a pressure plate having each of said rods extending therethrough such that said pressure plate is spaced from said second section of said mounting plate, said pressure plate having a pair of welds between said pressure plate and a respective one of said rods to attaching said pressure plate to said rods;

a push plate being coupled to each of said rods, said push plate having a central member extending between a pair of lobes, each of said lobes having a primary surface being directed toward said forward surface of said pressure plate, said second end of each of said rods being welded to said primary surface of a respective one of said lobes, each of said lobes extending upwardly from said central member wherein said central member is configured to rest on the floor joist having each of said lobes abutting a lateral edge of a floorboard being installed on the floor joist;

a nut being coupled to said second section; and a bolt being threaded into said nut and extending through said second section of said mounting plate, said bolt abutting said pressure plate, said bolt urging said pressure plate away from said second section of said mounting plate when said bolt is rotated in a first direction thereby urging said pressure plate away from said mounting plate wherein said push plate is configured to compress the floorboard into position for installation, said bolt facilitating said pressure plate to be moved toward said second section of said mounting plate when said bolt is rotated in a second direction.

2. The assembly according to claim 1, wherein said first section has a distal edge with respect to said second section, said first section having a top surface and a bottom surface wherein said bottom surface is configured to lie on top of the floor joist, said second section having a front surface and a back surface, said back surface lying on a perpendicular plane with respect to said top surface.

3. The assembly according to claim 2, wherein said first section has a pair of fastener holes each extending through said top surface and said bottom surface wherein each of said fastener holes is configured to have a fastener extended therethrough to engage the floor joist to fasten said mounting plate to the joist, said fastener holes being spaced apart from each other and being distributed between said distal edge and said second section.

4. The assembly according to claim 2, wherein said second section has a pair of rod holes each extending through said front surface and said back surface, each of said rod holes being positioned adjacent to a respective first lateral edge and a second lateral edge of said second section.

5. The assembly according to claim 4, wherein said second section has a bolt opening extending through said front surface and said back surface, said bolt opening being centrally positioned between said pair of rod holes.

6. The assembly according to claim 4, further comprising a pair of tabs, each of said tabs extending upwardly from said top surface of said first section, each of said tabs being oriented to lie on a plane being oriented perpendicular to said back surface of said second section, each of said tabs being positioned closer to said distal edge of said first section than said back surface of said second section, each of said tabs having a rod opening extending therethrough, said rod opening in each of said tabs being aligned with a respective one of said rod holes in said second section.

7. The assembly according to claim 6, wherein each of said rods has a first end and a second end, each of said rods extending through a respective one of said rod holes in said second section of said mounting plate and said rod opening in a respective one of said tabs, said first end being spaced from each of said tabs.

8. The assembly according to claim 2, wherein said pressure plate has a forward surface and a rearward surface, said rearward surface being directed toward said front surface of said second section, each of said rods extending through said rearward surface and said forward surface.

9. The assembly according to claim 5, wherein said nut is aligned with said bolt opening in said second section.

10. The assembly according to claim 9, wherein said bolt has a head and a stem, said stem being threaded to threadably engaging said nut such that said stem extends through said bolt opening, said stem having a distal end with respect to said head, said distal end abutting said rearward surface of said pressure plate, said head having a plurality of intersecting lateral edges thereby facilitating said head to be engaged by a wrench to rotate said bolt.

11. A flooring installation assembly for pressing a warped floorboard into position for proper installation, said assembly comprising:

a mounting plate being configured to be mounted to a floor joist during installation of floorboards onto the floor joist, said mounting plate comprising a first section being oriented perpendicular to a second section, said first section having a distal edge with respect to said second section, said first section having a top surface and a bottom surface wherein said bottom surface is configured to lie on top of the floor joist, said second section having a front surface and a back surface, said back surface lying on a perpendicular plane with respect to said top surface, said first section having a pair of fastener holes each extending through said top surface and said bottom surface wherein each of said fastener holes is configured to have a fastener extended therethrough to engage the floor joist to fasten said mounting plate to the joist, said fastener holes being spaced apart from each other and being distributed between said distal edge and said second section, said second section having a pair of rod holes each extending through said front surface and said back surface, each of said rod holes being positioned adjacent to a respective first lateral edge and a second lateral edge of said second section, said second section having a bolt opening extending through said front surface and said back surface, said bolt opening being centrally positioned between said pair of rod holes;

a pair of tabs, each of said tabs extending upwardly from said top surface of said first section, each of said tabs being oriented to lie on a plane being oriented perpendicular to said back surface of said second section, each of said tabs being positioned closer to said distal edge of said first section than said back surface of said second section, each of said tabs having a rod opening extending therethrough, said rod opening in each of said tabs being aligned with a respective one of said rod holes in said second section;

a pair of rods, each of said rods slidably extending through said second section of said mounting plate, each of said rods having a first end and a second end, each of said rods extending through a respective one of said rod holes in said second section of said mounting plate and said rod opening in a respective one of said tabs, said first end being spaced from each of said tabs;

a pressure plate having each of said rods extending therethrough such that said pressure plate is spaced from said second section of said mounting plate, said pressure plate having a pair of welds between said pressure plate and a respective one of said rods to attaching said pressure plate to said rods, said pressure plate having a forward surface and a rearward surface, said rearward surface being directed toward said front surface of said second section, each of said rods extending through said rearward surface and said forward surface;

a push plate being coupled to each of said rods, said push plate having a central member extending between a pair of lobes, each of said lobes having a primary surface being directed toward said forward surface of said pressure plate, said second end of each of said rods being welded to said primary surface of a respective one of said lobes, each of said lobes extending upwardly from said central member wherein said central member is configured to rest on the floor joist having each of said lobes abutting a lateral edge of a floorboard being installed on the floor joist;

a nut being coupled to said back surface of said second section, said nut being aligned with said bolt opening in said second section; and a bolt being threaded into said bolt, said bolt abutting said pressure plate, said bolt urging said pressure plate away from said second section of said mounting plate when said bolt is rotated in a first direction thereby urging said pressure plate away from said mounting plate wherein said push plate is configured to compress the floorboard into position for installation, said bolt facilitating said pressure plate to be moved toward said second section of said mounting plate when said bolt is rotated in a second direction, said bolt having a head and a stem, said stem being threaded to threadably engaging said nut, said stem having a distal end with respect to said head, said distal end abutting said rearward surface of said pressure plate, said head having a plurality of intersecting lateral edges thereby facilitating said head to be engaged by a wrench to rotate said bolt.

* * * * *